United States Patent [19]

Menear

[11] Patent Number: 4,604,959

[45] **Date of Patent: * Aug. 12, 1986**

[54] WIND-PROPELLED CRAFT

[76] Inventor: Michael J. Menear, 14 Lodge Way, Shepperton, Middlesex TW17 0RZ, England

[ * ] Notice: The portion of the term of this patent subsequent to Oct. 23, 2001 has been disclaimed.

[21] Appl. No.: 662,086

[22] Filed: Oct. 18, 1984

Related U.S. Application Data

[63] Continuation of Ser. No. 397,947, Jul. 13, 1982, Pat. No. 4,478,164.

[51] Int. Cl.[4] ..... B63H 9/04; B63B 39/00

[52] U.S. Cl. ..... 114/39; 114/91; 114/103; 114/97

[58] Field of Search ..... 114/39.1, 39.2, 102, 114/90, 91, 97, 103

[56] References Cited

U.S. PATENT DOCUMENTS

Re. 31,167 3/1983 Schweitzer et al. ..... 114/39.2

3,800,724 4/1974 Tracy ..... 114/39.1

4,478,164 10/1984 Menear ..... 114/39

*Primary Examiner*—Trygve M. Blix

*Assistant Examiner*—Edwin L. Swinehart

[57] ABSTRACT

A wind-propelled craft is disclosed which comprises a hull supporting a pair of unstayed masts arranged to pivot about an axis lying in approximately horizontal plane between a first position, in which one mast extends substantially vertically and the other extends generally at right-angles thereto away from the hull, and a second position, in which the relative configuration of the masts is reversed, each mast, in use, having a sail attached thereto or incorporating an aerofoil, whereby in use one sail or aerofoil can be trimmed to the wind to provide forward propulsion while the other sail or aerofoil simultaneously provides upward lift tending to counteract rolling or heeling force applied to the hull by wind impinging on the first sail or aerofoil. A steering control system is also described in which a steering link passes from a control point through the region of the pivot point of a mast to a rudder.

11 Claims, 15 Drawing Figures

WIND-PROPELLED CRAFT

This is a continuation of application Ser. No. 397,947 filed July 13, 1982 U.S. Pat. No. 4,478,164.

BACKGROUND OF THE INVENTION

This invention relates to a wind-propelled craft of the kind in which the mast is unstayed and supported by the crew. Water-craft of this kind are commonly termed "sailboards" and the present invention will be particularly described in its application to sailboards of improved performance.

In this specification there will be many references to sailboards and attention is directed to British Pat. Nos. 1,551,426 and 1,258,317 for background information on the construction of conventional sailboards.

The maximum speed of a craft can be increased only by increasing the propulsive force acting on it and/or reducing the resistance to forward motion which it experiences. The conventional sailboard configuration has inherent limitations which make significant improvement of either of these aspects impossible. The present invention is directed to the attainment of higher maximum speeds by avoiding (or reducing the effect of) these limitations.

In conventional sailboards travelling at high speed, the craft is subjected to a large headwind component which means that the sail must be trimmed close to the longitudinal axis of the board. Consequently, only a relatively small (propulsive) component of the total sail force acts forward, and a much larger component acts across the board, tending to roll it over. With a conventional sailboard the rolling moment of the sail force can only be counter-balanced by the crew using his weight by leaning backwards (to windward). This sets an absolute limit to the rolling moment which can be balanced since the weight of a given crew is fixed, as is the maximum moment arm on which it can act. Consequently, for any given set of conditions, the maximum propulsive force attainable is also limited by this factor.

Furthermore, as the limit is approached, the proportion of the sail force directed forward is reduced since the sail force vector is tilted upwards. This follows from the fact that the crew's arms, once straight, are virtually inextensible and so it becomes impossible to lean any further to windward without also pulling the sail to windward. For small angles of tilt the reduction of propulsive component is negligible and the vertical (lift) component has the beneficial effect of reducing displacement and consequently also reducing the hydrodynamic resistance to motion. Nevertheless, for conventional sailboards, this effect is soon outweighed by the reduction of the propulsive component and by the time the sail is tilted to 45° the loss is approximately 30%. (In the ultimate case, with the sail horizontal, it would generate lift and drag, but no propulsive component).

SUMMARY OF THE INVENTION

According to the present invention there is provided a wind-propelled craft which comprises a hull supporting a pair of unstayed masts arranged to pivot about an axis lying in an approximately horizontal plane between a first position, in which one mast extends substantially vertically and the other extends generally at right-angles thereto away from the hull, and a second position, in which the relative configuration of the masts is reversed, each mast, in use, having a sail attached thereto or incorporating an aerofoil so that one sail or aerofoil can be trimmed to the wind to provide forward propulsion while the other sail or aerofoil simultaneously provides upward lift tending to counteract the rolling or heeling force applied to the hull by wind impinging on the first sail or aerofoil.

Another feature of the invention is directed to a sailboard comprising a hull supporting a universal joint assembly having an unstayed mast structure mounted thereon for pivoting movement about three mutually perpendicular axes. The mast structure includes a mast having a sail attached at one end thereof to the mast and a boom means connected at one end to the mast and at the other to a free end of the sail. A steering control means comprises a water rudder connected by at least one control line passing through the region of the universal joint assembly and actuatable by said boom means.

BRIEF DESCRIPTION OF DRAWINGS

Various embodiments and aspects of the present invention will now be described, by way of illustration, with reference to the accompanying drawings in which:

FIGS. 1 and 2 have already been discussed above and explain the principles and advantages of providing a sailboard with a rig comprising a pair of masts which are linked together by means of a generally quadrilateral frame formed from a pair of booms connected by a forward cross strut and a rearward cross strut.

DETAILED DESCRIPTION

Figure 1:
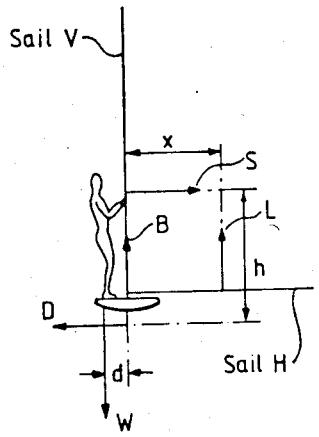
FIG. 1 is a diagrammatic end elevation of a twin sail craft in accordance with the invention showing the balance of forces to which it is subjected in use.

The principle of the present invention is shown in FIG. 1 of the accompanying drawings (which is a diagrammatic elevation of a craft in accordance with this invention) from which it can be seen that a sailboard is provided with a second sail, of similar size and characteristics to the first, the second sail being arranged approximately at right-angles and to leeward of the first sail. Thus the second sail is approximately horizontal and can be set to generate a vertical (lift) force of the same order as the cross-wind force generated by the first (vertical) sail.

The forces and distances represented in FIG. 1 are as follows:

Forces:

S = Lateral component of force generated by vertical sail V

L = Vertical component of force generated by horizontal sail H

D = Side force generated by Dagger board

W = Combined weight of crew and sailboard

B = Buoyancy force (= W-L)

Distances:

h = Moment arm of S (= height of Center of Pressure of vertical sail above Center of Pressure of Dagger board)

x = Moment of arm of L (= Lateral distance of Center of Pressure of horizontal sail from longitudinal axis of sailboard)

d = Moment of arm of W (= Lateral distance of Center of Gravity from longitudinal axis of sailboard).

The arrangement shown in FIG. 1 has three fundamental advantages:

(1) The rolling moment hS of the first sail force can be balanced by the opposing moment xL of the lift force plus the weight moment dW. This enables larger sail forces to be utilized than could be balanced by the crew's weight alone and so larger propulsive forces are attainable. (Furthermore, any changes in the sail cross-wind force moment due to change of wind speed are automatically compensated by a similar change in the lift force moment).

(2) Unlike conventional sailboards there is no need to tilt the rig as the sail force increases. Consequently, there is no reduction of the propulsive component for this reason.

(3) The lift force reduces displacement and hence reduces the hydrodynamic resistance to forward motion. Although when making the comparison, the weight and drag of the horizontal sail must be taken into account, a net reduction in total resistance is to be expected as, in this context, aerodynamic support should be more efficient than hydrodynamic support. (Although aerodynamic and hydrodynamic support efficiencies may be similar when the bodies under consideration are fully immersed in their respective fluids, at the air/water interface the hydrodynamic support efficiency is reduced by energy losses incurred by wave and spray formation, whereas aerodynamic efficiency is increased by the "Ground Effect").

Furthermore this lift effect is much greater than that caused by tilting a conventional sailboard rig as:

Firstly, the sail forces will generally be greater than those for conventional sailboards, for reasons noted above.

Secondly, the lift force is of the same order as the cross-wind force generated by the vertical sail, and is not merely some small proportion of it.

Hence the proposed configuration offers higher propulsive forces and lower resistance to forward motion than that of conventional sailboards.

Figure 4:
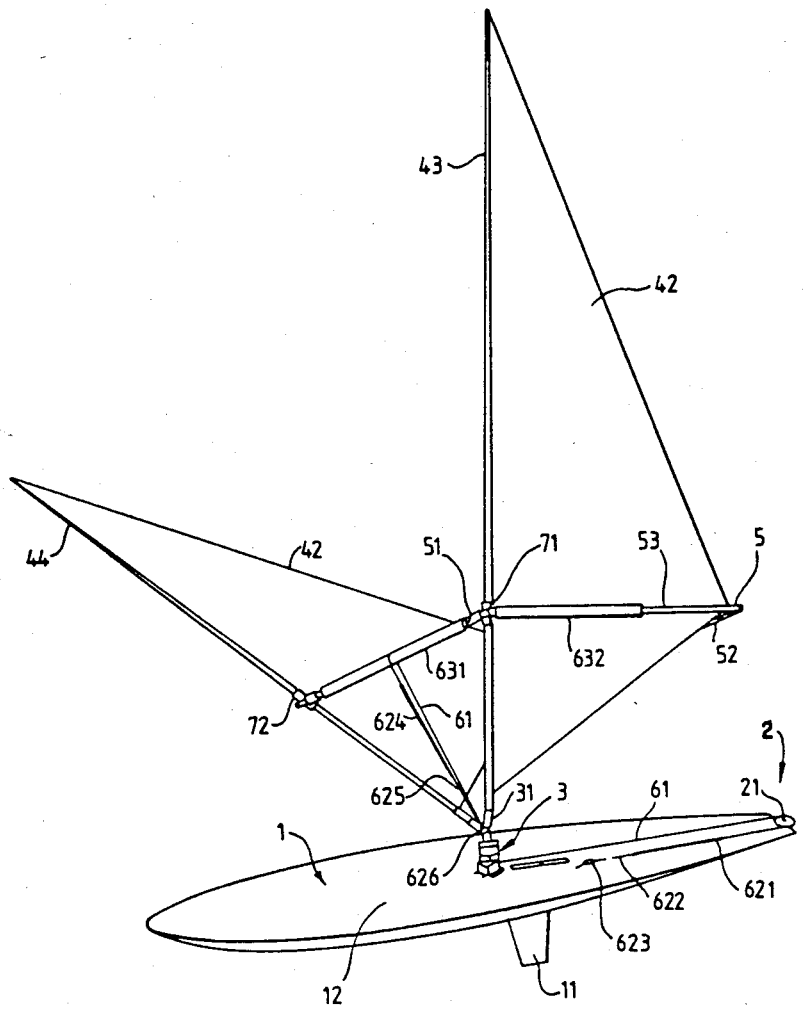
FIG. 4 is a perspective view of one embodiment of a sailboard in accordance with the invention.

The general arrangement of one embodiment in accordance with this invention is shown in FIG. 4. Thus, FIG. 4 shows a sailboard which utilizes conventional sailboard sails. In this case, the leading edge (luff) of each sail incorporates a luff sleeve to accommodate its mast. The aft corner (clew) of each sail may be held in position by attachment to the aft end of a boom, the forward end of which is secured to its respective mast. Each boom is located adjacent to the side of its respective sail which is remote from the other sail. The feet of the two masts are attached to the upper part of a universal joint, the lower part of which is secured to the hull of the sailboard. The relative positions of the two sails (and masts and booms) are maintained by two cross struts which link the forward and aft ends of the booms. The rectangular lateral frame formed by the two booms and two cross struts is preferably stabilized by cables in tension which link its diagonally opposite corners.

Figure 2:
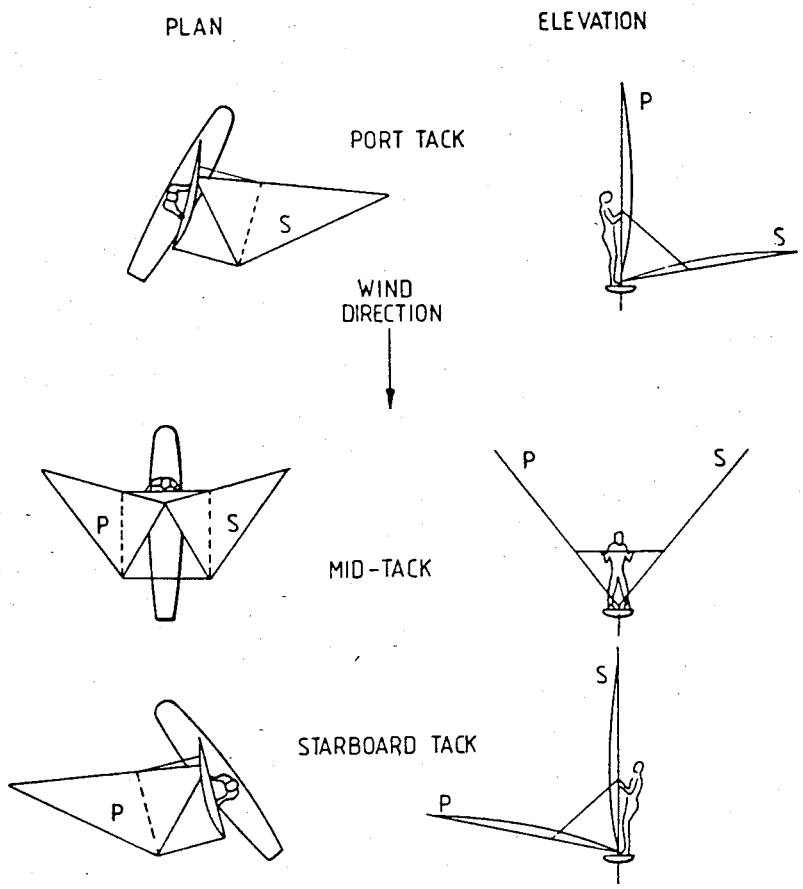
FIG. 2 is a series of diagrammatic views showing the positions of the sails of the craft of FIG. 1 while tacking.

For the aerodynamic rolling moments of the two sails to be opposed the horizontal sail must always be to leeward and so the sails must exchange functions when the sailboard tacks. This is shown diagrammatically in FIG. 2, in which the port sail is indicated by 'P' and the starboard sail by 'S'. The rig must therefore be constructed to maintain an angle of (approximately) 90° between the planes of the two sails and must be attached to the board by a joint which permits it to be rolled through 90° when tacking.

The incidence of the vertical sail will be controlled by the rotation of the rig in yaw, about the vertical axis through the universal joint, as with conventional sailboards. Control of the incidence of the horizontal sail will necessitate tilting the rig about a horizontal axis. Consequently, this motion will not be available for steering by movement of the center of pressure of the vertical sail, as with conventional sailboards. It is therefore preferred to provide a water rudder, located at or near the stern of the board. A preferred steering mechanism, which may also be used advantageously in conventional sailboards, will be described later. There is also described subsequently herein, an otherwise conventional sailboard having a simplified steering control mechanism linked to a water rudder which is primarily intended to improve steering performance during major maneuvers such as tacking.

The hull may be of a form and construction generally similar to sailboards, and incorporate a similar dagger board or centreboard. However, light displacement hulls similar to planing sailing dinghy hulls may also be suitable, as well as multi-hulls, such as catamarans and trimarans. Hulls which are designed specifically to utilize the proposed configuration may incorporate, as integral parts of their structure, housings to accommodate the appropriate universal joint and rudder mounting assemblies. Nevertheless, it will also be feasible to apply the present invention to most existing sailboard hulls, and modification kits, including a linked mast structure as shown in FIG. 4, may be supplied to convert conventional sailboards to craft in accordance with this invention.

Although the arrangement which is currently preferred involves one linked, twin mast or aerofoil structure which can be operated by a single crew member, the invention also envisages the broad concept of providing a second linked, twin mast or aerofoil structure which is independent of the first structure. The second structure would be controlled by a second crew member and steering might be the responsibility of a third crew member.

Figure 3:
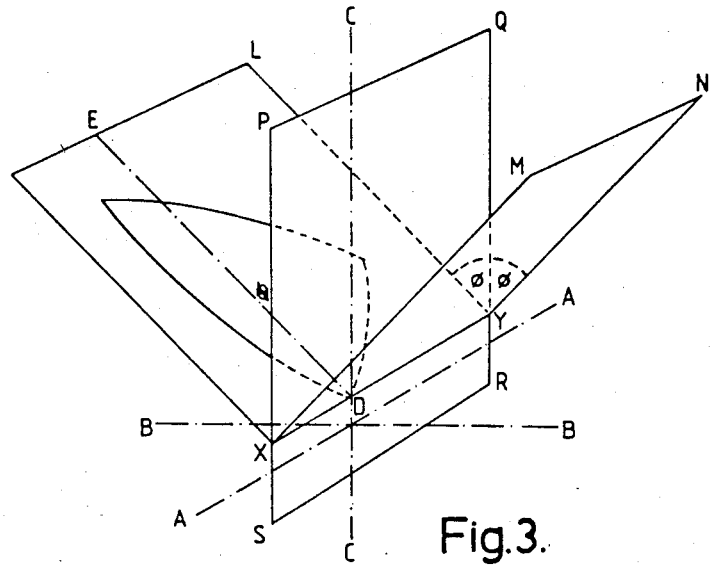
FIG. 3 is a perspective diagram showing the basic geometry of the rig of a craft as shown in FIGS. 1 and 4.

The basic geometry of the rig is illustrated in FIG. 3.

The rig utilizes two sails, of similar size, shape construction and characteristics and is symmetrical. The planes of the sails (KLYX, MNYX) converge and their line of intersection XY therefore lies in the plane of symmetry PQRS (the sail in plane MNYX is omitted for clarity). The planes of the sails are each displaced (in rotation about their line of intersection) by equal but opposite angles $\phi$ of approximately 45° from the plane of symmetry.

Although in theory the rig would be more efficient with an angle of 90° between the planes of the sails, in practice it may be desirable to reduce this angle slightly, perhaps 80°–85° to ensure adequate wave clearance for the lower sail.

Although there is also the alternative of retaining the 90° angle, and providing wave clearance by tilting the rig windward, this seems likely to be less convenient for the crew. Nevertheless, this possibility must not be excluded, and so the angle between the planes of the sails cannot be specified exactly, since there is a range of potential feasible values.

The lower part of the rig is connected to the upper part of a joint, the lower part of which is connected to the hull of the sailboard. The joint is preferably universal and permits rotation of the rig about three mutually perpendicular axes.

One of these axes AA is parallel to the line of intersection XY and lies in the plane of symmetry of the rig. Rotation of the rig about this axis enables the plane of one sail to be raised to a vertical position as the plane of the other sail assumes a near horizontal position, and vice versa. The total range of rotation available about this axis should be equal to, or exceed, the angle between the planes of the two sails.

A second axis BB is perpendicular to the plane of symmetry of the rig. The total range of rotation available about this axis should at least equal the range of incidence which either sail may be required to adopt when the other sail is vertical, but preferably should approach 180°.

The third axis CC is at right-angles to the first (AA), and also lies in the plane of symmetry of the rig. Preferably, it should also be perpendicular to the waterline plane of the sailboard hull. Although it would be possible to operate a rig for which the available rotation about this axis was less than 360°, such a constraint would be inconvenient, and in some circumstances, dangerous. It is therefore advisable that rotation about this axis should be unlimited, in both directions.

The disposition of the sails should be such that, in normal operation, their respective Centers of Pressure should remain slightly down wind of the reference plane which contains the second and third axes, BB and CC. This ensures that the action of the cross-wind forces of the sails tends to reduce their respective incidences (by "weather-cocking") thus offsetting the destabilizing effects of the drag moments of the sails. This feature is highly desirable.

The rig will incorporate suitable structural provision for the crew to grasp it from either side and from the upwind end, in order to support and control it.

Sail Orientation

"Orientation" refers to the positioning of the sail planforms (within their planes) in relation to the axes about which they are rotated to vary their incidences.

The main fact determining sail orientation is the stability requirement for the Centers of Pressure of the sails in normal operation to remain at least slightly down wind of the respective axes about which they are rotated to vary incidence. In this context "normal operation" refers to points of sail where the wind direction is broadly parallel to the plane of the vertical sail and incidence is not more than about 25°.

This stability requirement can be met by arranging sail orientation so that with both sails at zero incidence the relevant axes of rotation may intersect the mean chords of the sails at points no more than 30% aft of the leading edges of the mean chords. (In "normal operation", as defined above, the Centers of Pressure usually lie between 35% and 40% of the mean chords).

Sail Shape

Although the sail arrangemment of FIG. 4 would meet the major requirements, and could utilize conventional construction techniques, it has two secondary disadvantages:

(1) The aft ends of the booms project a considerable distance aft of the axes of rotation. This increases the danger of immersion when positive incidence is applied to the "horizontal " sail.

(2) The shape of most sailboard sails is not a very close approximation to the minimum drag ideal.

These problems could be alleviated by sails of higher aspect ratio in which the area is distributed more evenly along the span, and the aft end of the boom does not project as far. Consequently, the recently introduced 'high clew high aspect ratio' sailboard sails, which can be used on relatively short booms, are to be preferred, and would be aerodynamically more efficient for and on the twin sail rig than earlier types of board sails.

Inter-Sail Angle

It is convenient to consider firstly the optimum position for each sail in isolation.

For maximum performance the "horizontal" sail should not tilt upwards as, in addition to causing a slight loss of lift, the tilt would create a component which would oppose the propulsive force generated by the vertical sail. Nevertheless, the sail should not droop either as, although this would provide an increment to the propulsive force, it would aggravate the problem of wave clearance. Hence, the ideal setting for the "horizontal" sail probably is truly horizontal, provided that this is consistent with adequate wave clearance.

The vertical sail must not tilt towards the other sail as this would create an anti-lift component. However, a slight tilt in the opposite direction could be worthwhile as it would provide significant augmentation of lift for a relatively small loss of propulsive force.

Hence, if wave clearance is adequate with the "horizontal" sail horizontal, then there is a case for adopting an inter-sail angle of around 105°. Although this would slightly reduce the space for the crew when close-hauled, sails tilted 15° to windward do not seem to inconvenience crews of conventional sailboards unduly.

Alternatively, if wave clearance is a problem, an inter-sail angle of 90° could be adopted, and a 15° tilt to windward used to increase the wave clearance of the "horizontal" sail. In this case, the additional lift from the vertical sail would help to offset the unwanted anti-propulsive component created by tilting the "horizontal" sail.

It may be noted that theoretically the propulsive and lifting components of the two sails would be maximized by an inter-sail angle of 90° with both sails at 45° to the horizontal. Both components would then have values 41% above those obtained with one sail vertical and the other horizontal. However, this arrangement would represent a totally different and less practical type of rig. Furthermore, the rate of improvement decreases as the inter-sail angle increases and more than half of the maximum improvement, in fact 54% of it, would be achieved by adopting 105°.

Roll Pivot Height

Although the preceding section noted the merits of setting the "horizontal" sail truly horizontal, it would clearly be impracticable for it to extend horzontally at deck level. In such a case, the trailing edge (leech) would inevitably be immersed by the application of positive incidence to the sail, if not by wave impact. Although the simplest solution appears to be to raise the whole "horizontal" sail bodily to an adequate height, this would have important effects on other aspects which must also be considered.

The most important is that raising the rig increases the rolling moment arm of the force generated by the vertical sail, but does not provide any compensating effect on the other rolling moments. This aspect sets an ultimate limit to the roll pivot height which is compatible with maintaining equilibrium in roll under a given set of conditions. Since the maximum pivot height is reduced as the sail forces increase, it is proposed to design the relevant components to cater for a range of different inter-sail angles and pivot heights.

For example, in light winds, roll stability presents no difficulty, and so an extension could be fitted to the universal joint to raise the roll pivot well above deck level. This would have two beneficial effects:

(1) It would enable the more efficient intersail angle of 105° to be used without encountering wave clearance problems.

(2) Raising the entire rig would increase the average wind speed which it experienced, and hence increase the propulsive and lift forces.

It is envisaged that the lateral frame (of booms and struts) would be used, but fitted nearer to the pivot than usual, as indeed it would have to be to remain within easy reach of the crew.

Conversely, in heavy winds the roll pivot would be set close to the deck and the frame raised to reduce the inter-sail angle, perhaps to 75°, thus maintaining adequate wave clearance. The loss of efficiency thus incurred would probably be acceptable in view of the high sail forces generated by the high wind. (The high clew sails mentioned above have an additional advantage when the inter-sail angle is less the 90° as, since the after-most part of the rig is then higher than with low clew sails, this increases wave clearance).

Thus, the selection of the roll pivot height involves a compromise between the requirements of wave clearance, roll stability, and performance.

The problem of wave clearance can be further alleviated by utilizing a forward strut which is shorter than the aft strut, thus forcing the sails to "toe in". For example, the dimensions could be arranged to ensure that, when the vertical sail was in its normal position with respect to pitching rotation, the horizontal sail was set at its normal operating incidence. Thus with the horizontal sail "already" at its normal operating incidence, there would be no need to rake the vertical said further aft and further decrease wave clearance.

OPTIONAL FEATURES

Rig construction may be conventional, with flexible sails set on rigid spars (such as masts and booms), or may utilize alternative forms of construction such as those used for the wings of ultra-light aircraft.

It is a particular feature of the rig configuration that the low pressure area is normally on the same side of each sail, whether it is operating horizontally or vertically. (By contrast, with conventional single sail rigs, the low pressure area is on the opposite side of the sail when on the opposite tack). This characteristic means that it is feasible to use sails or aerofoils incorporating high lift asymmetric sections. It is also theoretically possible to use the high lift devices used by aircraft, such as slats and flaps. The availability of high performance aerofoils could enable the performance of the sailboard to be further improved, or the datum level of performance to be maintained by a smaller rig.

If the sailboard to which the rig is to be fitted is designed for single handed operation (so that the person controlling the rig is also required to steer) then the rig and universal joint may incorporate features relating to the steering system.

It may prove advisable to fit a small float at the outer extremity (e.g. masthead) of each sail, to prevent sinking of the lower sail when allowed to settle on the water. It is also possible, but less likely, that similar floats should be fitted to the trailing extremities of each sail, for example at the aft end of each boom. With such provisions some part of the rig structure would normally be within easy reach of the crew and so a rig uphaul, as used on conventional sailboard rigs, would not be required. However, the method of running before the wind with the rig tilted forward symmetrically may require an uphaul attached to the aft end of each boom.

It should be emphasised that the rig is applicable not only to sailboards designed specifically to utilize it, but also to existing boards which were originally intended to use conventional single sail rigs.

The detailed design of the rig should preferably provide for ease of assembly and dismantling to facilitate its transport, in particular by car roof rack.

STEERING SYSTEMS

The desirability of providing a steering system using a water rudder, preferably one which can be operated by a single crew member, has already been mentioned. The conventional sailboard, having no rudder, is steered by the crew tilting the rig forward or aft as required. This action alters the longitudinal position of the Center of Pressure (CP) of the sail relative to the Center of Lateral Resistance (CLR) of the immersed parts of the board, and so generates unbalanced yawing moments which then turn the board.

This steering method has two basic advantages:

(1) The board will only sail straight if it is correctly trimmed. By contrast, with a sailing dinghy it is possible to sail straight when badly trimmed, with the rudder working in opposition to the Center board and generating more resistance than it would with correct trim.

(2) The fixed skeg is clearly simpler and cheaper than any rudder could be.

Furthermore it would appear that since the crew needs both feet free to maintain his balance on the board, and both hands are needed to support and control the rig, he has no limbs available to operate a separate steering system.

Nevertheless, although the advantages are undeniable this method of steering also has some significant limitations.

The function of a steering system may be considered to be the generation of turning moments about the CLR and its performance may be assessed on the magnitude of the moments which it is able to generate and also on the rate at which the moments can be applied. (Clearly a system which takes a relatively long time to generate a low maximum turning moment must be considered to be inefficient.)

The maximum turning moment attainable is the product of two other factors; the maximum force which can be generated and the maximum moment arm to which it can be applied, assuming that both maxima are attainable concurrently.

Although it is impossible to generalize with precision, it seems likely that during normal maneuvering the sail CP of a conventional sailboard will not move more than about 2 feet forward or aft of the CLR. By contrast, a rudder if fitted at the stern would be at least 4 feet aft of the CLR. Hence the rudder force moment arm would probably exceed the sail force moment arm by a factor of at least 2.

The cross-stream forces generated by the sail and rudder may be calculated from the expression:

$$F=0.5pV^2SC_L$$

Where p=Fluid density (air or water)

V=Relative speed of fluid

S=Surface area (of sail or rudder)

$C_L$=Lift coefficient

Of these factors, $C_L$ should probably be considered to be identical for sail and rudder. Although the maximum value attainable is likely to be higher for the sail than the rudder (due to greater sail chamber), in most phases of sailing the sail $C_L$ will be determined by factors other than the steering requirement, and is therefore likely to be significantly less than its maximum value.

Hence the forces attainable may be compared by comparing the values of ($pV^2S$) for the sail and rudder.

The density factor is easy to assess: water is approximately 840 times denser than air.

The area comparison is only slightly more problematical, and values of 60 and 0.5 (square feet) for sail and rudder respectively are probably realistic, giving a ratio of 120.

Speed comparisons are inherently less sound since high water speeds may occur concurrently with low wind speeds (temporarily) and vice versa. However, with a beam wind a well sailed board should attain speeds of the same order as the wind speed. Due to the headwind component caused by forward motion the apparent wind speed experienced by the sail is increased by about 40%. Hence in this case $V^2$ for the sail would exceed the value for the rudder by a factor of about 2.

Summarizing, on the above assumptions, the rudder force could be expected to exceed the sail force by $840\div(120\times2)$, which is a factor of 3.5.

Since it has already been established that the rudder moment arm would be greater by a factor of at least 2, it would seem that a steering system based on a conventional rudder could provide turning moments up to 7 times greater than those available from the conventional sailboard steering method.

Furthermore, it seems fairly certain that the rotation of a small, low inertia rudder could be achieved more rapidly than tilting the entire rig, which has much greater inertia. Consequently the rate of response of a rudder based system could also be expected to be superior.

The above comparisons clearly represent a significant incentive to develop a rudder based steering system for conventionsl sailboards.

According to a further aspect of the present invention therefore there is provided a sailboard steering system wherein each boom includes or incorporates a steering control device and means responsive to movement of said control for transmitting such movement or a signal related thereto to a rudder.

Although such a system would necessarily sacrifice the virtue of extreme simplicity, it should provide a substantial improvement of steering efficiency. Moreover especially when used in conjunction with an otherwise conventional sailboard rig, the ability to optimize directional trim by tilting the rig would be retained. Conversely, since the tilting motion of the rig would no longer be required for steering it could be utilized to control some other aspect, if so required by a different form of rig.

A rudder based system of the type contemplated has three main elements. Firstly there is the rudder itself. Secondly there must be means for the crew to apply control movements to the system. Thirdly, there must be an element which connects the first two together.

Since the crew is required to grasp the boom in order to support and control the rig, the provision of a control device which is associated with the boom for steering the craft is a very convenient arrangement for increasing the overall control over the operation of the craft.

The variations of sail forces require the hands to be able to adopt a range of different positions on the boom. Consequently any system to be used for the application of control movements to the rudder system must permit the hands to adopt the same range of positions.

Steering systems of two basic types have been investigated in which control movement is transmitted from the booms to the rudder. These are first a rotatable control device mounted on the booms and secondly a device which is responsive to a pivoting movement of the booms about an axis which extends longitudinally of the boom and is parallel with it. The former system has been found to be preferable in sailboards fitted with twin sails, while the latter system is preferred for use with conventional single-masted sailboard. In the case of the latter steering system it has been found to be convenient to provide some kind of lost motion arrangement with the steering mechanism so that the rudder is not subjected to small changes in pivoting movements of the booms.

Generally speaking, in the case of a twin sail craft a twist-grip steering control is preferred and normally the axis of such a grip should be approximately parallel if not actually coaxial with that of the boom itself. The wrist movement required is thus similar to that used to operate the twist grip controls fitted to motor cycles.

In the preferred version, the twist-grip is a straight circular tube and is mounted on a section of the boom which passes through it. The section of the boom shrouded by the twist-grip should also be straight and circular, and be coaxial with the grip. (The part of the boom aft of the twist-grip may be of a different section and/or be bent or curved). Although in a simplest version a low friction plastic grip would bear directly on a metal boom, discrete plain, ball or roller bearings may be interposed between the grip and the boom if required.

Although it is possible to devise a variety of systems for transmitting the movement of the twist-grip to the rudder and translating this movement into appropriate pivotal movement of the rudder, systems involving hydraulic, pneumatic and electrical power or signals are likely to be too expensive. It is therefore anticipated that a mechanical linkage involving lines or cables will be adopted, at least in part, in most sailboards utilizing the steering systems of this invention.

The next question to be considered is the route to be taken by the link between the twist-grip and the rudder. It has already been noted that yawing rotation of the rig about the vertical axis through the universal joint should be unrestricted. In order to avoid any restriction in movement of the universal joint, the transmission path for steering cables, lines or the like should in effect, pass along this axis at some stage. As broadly similar considerations apply to the other axes, any mechanical transmission link will normally be routed via the universal joint.

Transmission of control movements through the universal joint, without restricting yawing rotation of the rig, is a major design problem. Several solutions are feasible, and four are outlined by way of example:

(1) A swivel link comprises upper and lower elements connected by a swivel, and is constrained to move vertically by upper and lower sets of guide rollers. The upper guide rollers also constrain the upper element to rotate in yaw with the rig. The lower guide rollers constrain the lower element to move with the hull in yaw. The rudder is controlled by the vertical movement of the link, transmitted via the swivel.

(2) The twist-grip rotates a gear wheel (located within the universal joint assembly) about the vertical axis. This wheel also rotates as the rig yaws, but is connected to a differential gearing system which senses the rig movement and automatically compensates for it, enabling the twist-grip movements to be transmitted to the rudder, unaffected by yawing rotation of the rig.

(3) The twist-grip operates a piston within a hydraulic cylinder, forcing fluid along a connecting tube which passes through the universal joint, and terminates at a second hydraulic cylinder. The fluid moves the second piston, which is linked to the rudder. Within the universal joint the connecting tube incorporates three rotating couplings, each one centred on one of the axes of rotation of the joint.

(4) A single flexible control line is constrained to pass through the center of the universal joint and is kept taut by return springs attached to its ends.

Whichever method is adopted, the links from the twist-grip to the upper part of the universal joint, and from the lower to the rudder, should preferably utilize cords or cables in tension, as this method is generally lighter, cheaper and more robust than alternatives such as push-rods or hydraulic tubes.

The steering system will therefore normally comprise:

Two (or more) twist-grips, mounted on the rig structure. (At least one twist-grip is mounted on each side of the rig).

At least one rudder, fitted at or near the stern of the sailboard.

A connecting system, which conveys the control movements from the twist-grips to the rudder(s) via the universal joint which links the rig to the hull.

Additional twist-grips may be provided, for example across the front of the rig. In the case of the twin-sail invention previously described it will be desirable to fit an additional twist-grip on the forward cross-strut (for use when tacking) and perhaps also on the rearward cross-strut. Twist grips fitted to the sides of the rig should preferably be mounted on the booms or equivalent structure. Twist grips should preferably take the form of straight circular tubes surrounding, and coaxial with, the structural elements on which they are mounted.

Any convenient method may be utilized to convey control movements through the universal joint, but simple mechanical alternatives, such as the swivel link and single line systems outlined above are preferable.

The rudder, universal joint and boom/twist-grip assemblies may be designed to facilitate their fitment to existing types of sailboard hull and mast.

The universal joint may incorporate fittings to enable it to be used with more than one type of rig, for example with both single and twin sail types.

Referring to FIG. 4, this shows a sailboard having a hull 1 which is broadly similar in shape, overall dimensions and construction to the hulls of conventional sailboards, and is equipped with a conventional pivotting centerboard 11. The rig is attached to the upper surface (deck) 12 of the hull by a universal joint 3 and comprises two sails 41 and 42 (of similar size, shape and characteristics) which are held at approximately 90° to each other by a lateral frame 5 linked to the masts on which the sails are set. The feet of the masts 43 and 44 are mounted on a fitting 31 which forms the upper element of the universal joint 3.

Conventional sailboard masts and sails are utilized. It is preferable for the sails to be of the high aspect ratio, high clew type which are able to utilized relatively short booms.

The aft corner (clew) of each sail is held in position by a clew outhaul line which is cleated to the aft end of a boom, the forward end of which is secured to its respective mast. Each boom is located adjacent to the side of its respective sail which is remote from the other sail. The relative positions of the two sails (and masts and boooms) are maintained by two cross struts 51 and 52 which link the forward and aft ends of the booms 53 and 54. The lateral frame formed by the booms and struts is stabilized by cables in tension which link the diagonally opposite corners.

A rudder 2 is mounted at the stern of the hull. Its construction is broadly similar to orthodox sailing dinghy practice except that the tiller is replaced by an operating sheave 21 which is coaxial with the rudder and rotates with it.

Figure 13:
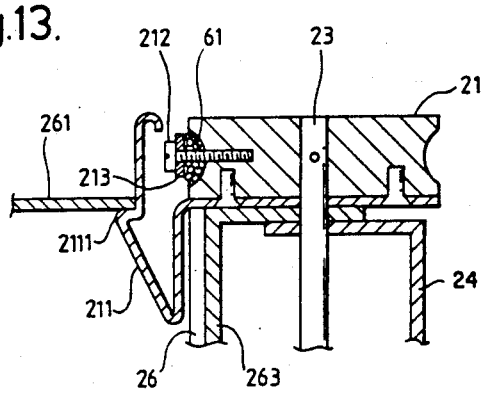
FIG. 13 is a cross-section through the operating sheave showing the method of attaching the control line, and the method of securing the sheave.

A control line 61 passes round sheave 21 to which it is secured by a screw 212 (see FIG. 13). One end of the line 61 is attached to an elastic cord 621 which acts as a return spring. The other end of cord 621 is attached to a short length of line 622 which is secured by a cleat 623 mounted on the upper surface of the hull, just aft of the centerboard slot. The other end of control line 61 runs forward just above the deck and round guide sheaves (not shown in FIG. 4) before turning upwards to pass through the center of the universal joint and then on to a tubular twist grip 631 which encloses all but the ends of the forward cross strut 51. The line 61 passes round twist grip 631, to which it is attached, and is then connected to a second elastic cord 624 which also acts as a return spring. The other end of cord 624 is attached to a short length of line 625 which is secured by a cleat 626 mounted on the upper element of the universal joint. Additional twist grips 632 and 633 enclose the forward sections of booms 53 and 54 respectively, and are connected to twist grip 631 so as to rotate in unison with it. Thus rotation of any one of the twist grips 631, 632 and 633 causes a corresponding rotation of the rudder, and on release of the twist grips, the rudder is returned to its equilibrium position by springs 621 and 624.

Figure 6:
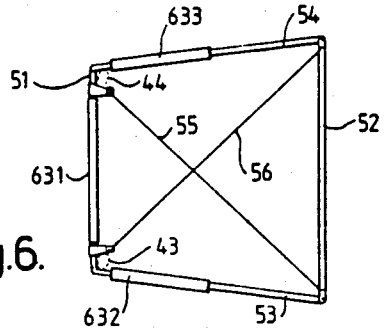
FIG. 6 is a plan view of the boom and cross strut structure of the sailboard of FIG. 4.

FIG. 6 is a plan view of the basic lateral frame 5, showing booms 53 and 54, cross struts 51 and 52, cross-bracing cables 55 and 56, and twist grips 631, 632, 633. The mast positions are shown in section (dotted) but details of fittings, sails and other components are omitted in the interests of clarity.

The booms and struts are straight circular section tubes of aluminium alloy the ends of which are plugged by joint fittings of structural plastic. The fittings in the cross struts have projecting forks whereas those in the booms incorporate tongues designed to engage with the forks. The joint fittings are fastened together by stainless steel clevis pins which pass through both tongue and forks, and are secured by spring retainer rings.

Figure 7:
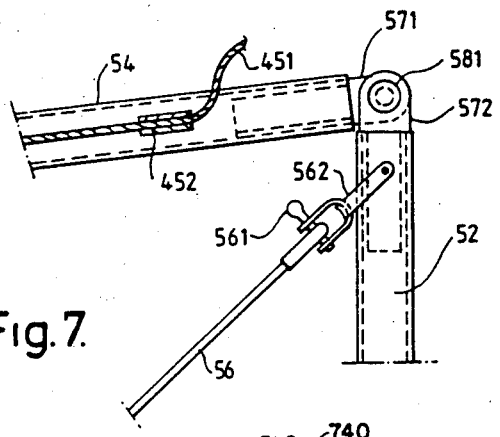
FIG. 7 is an enlarged view of the structure shown in FIG. 6 showing details of the connection between a boom and the rear strut.

FIG. 7 is a plan view of the aft starboard corner of the frame 5 showing the starboard boom 54, which has tongued joint fitting 571; the aft cross strut 52 which has a forked joint fitting 572, a clevis pin 581 and a retainer ring (not shown); the cross-bracing cable 56 which has a shackle 561 and a strap 562, a clew outhaul 451 and an outhaul cleat 452.

The forward ends of the bracing wires are attached to brackets mounted on the forward cross strut, details of which are described below.

Referring to FIGS. 8 to 11, the forward strut 51 is attached to the masts 43 and 44 at the points where the sail luff sleeves are cut away to permit attachment to the wishbone booms when the sails are used on conventional sailboards. At these points attachment fittings (71 and 72) are clamped to the masts by hose clips 731 of the type which utilize worm drives to tighten flat stainless steel bands. Each fitting is made from a short length of aluminium alloy channel section of dimensions which enable it to enclose the worm drive assemblies and the free ends of the clamping bands. Each band passes out through a slot in one side of the channel then round the mast and back in through a slot on the opposite side of the channel. This arrangement is shown in FIG. 10*a* which is a cross-section of the mast 44 and fitting 72 taken on the center-line of the hose clip 731. Each attachment fitting is clamped to its respective mast by two hose clips.

Each fitting carries a spigot 740 perpendicular to its base, which engages with a hole in the aft face of the forward cross strut. The spigot comprises a short length of hard nylon tubing 741 fastened to the fitting 72 at or near to the center of its base by a cheesehead bolt 742 secured by a stiff nut (not shown) within the channel section.

Figure 11:
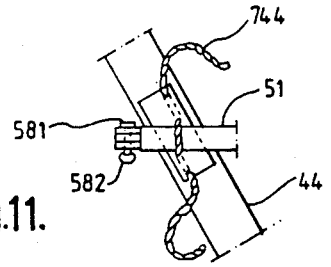
FIG. 11 is a fragmentary front elevation showing the method of using the connector devices shown in FIG. 10 and 10*a* for securing the cross-strut to a mast.

The spigot is held in engagement with the strut by a retaining line 744 which, from a stop knot within the fitting passes out through a hole 745 in the base of the channel adjacent to the strut, then round the strut and back through a second hole 746 in the channel base before emerging from the end of the channel where it is cleated in a Vee notch 747 in the channel base (see FIG. 11). The other end of the line leaves the other end of the channel where it is cleated in a second Vee notch 748. The two free ends are then tied together over the strut as a further security measure.

Figure 10:
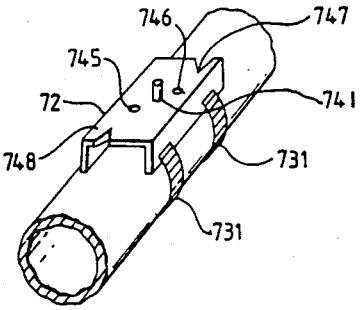
FIG. 10 is a fragmentary perspective view showing details of one of the connector devices for releasably connecting the forward cross strut to one of the masts.
Figure 10A:
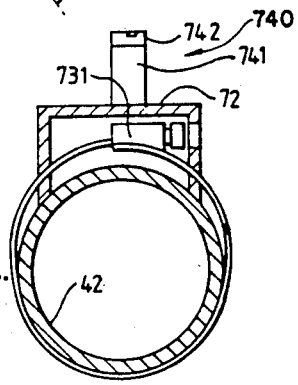
FIG. 10*a* is a cross-sectional view of the mast and connector in FIG. 10.

FIG. 10 shows one of the fittings clamped to a mast, with the strut and retaining line omitted for clarity.

Figure 5:
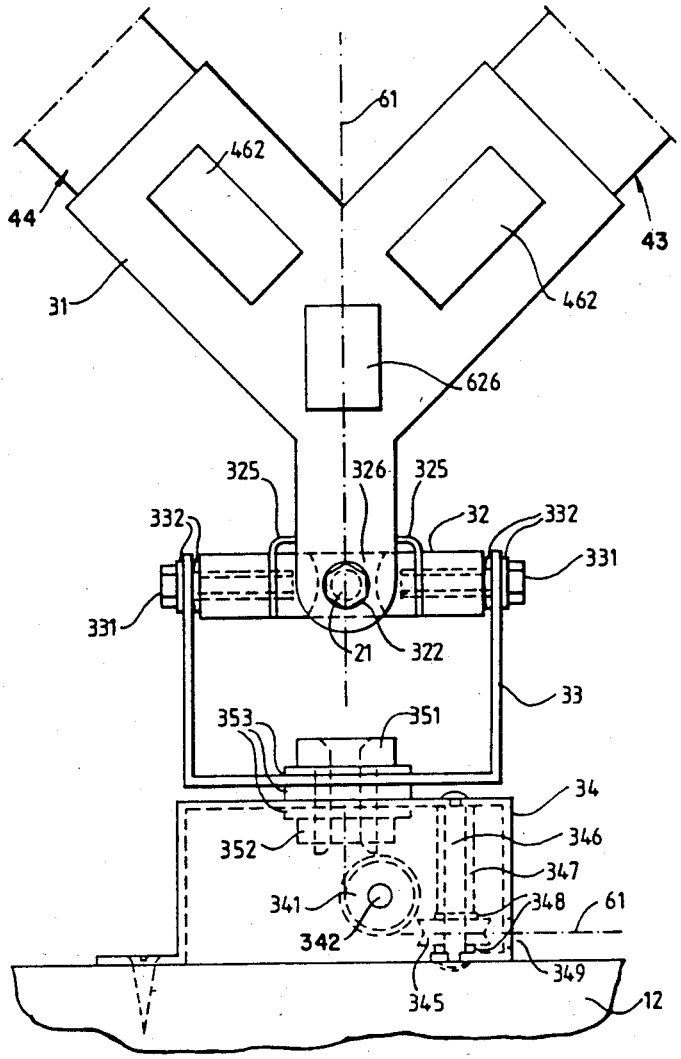
FIG. 5 is an elevation of the universal joint and associated parts of the sailboard shown in FIG. 4.

FIG. 5 shows details of the universal joint assembly 3 and associated Y-piece 31. The upper part of the joint is shown as seen from a position beneath the center of the aft cross strut 52.

The feet of masts 43 and 44 are plugged by the upper two legs of a Y-piece 31 of structural plastic. The third (central) leg is forked and straddles a thick aluminium alloy disc 32 to which it is secured by pivot bolts 321. The Y-piece also carries the cleats 626 and 462 to which the line 625 and the sail downhauls 461 respectively are secured.

Each pivot bolt 321 passes firstly through a washer 322 then through a hard nylon bush (not shown) pressed into one prong of the Y-piece and a second washer (not shown) before being screwed into the disc. The bolt is locked in correct adjustment by locking wire 325 passing through a hole drilled through the disc 32 and the end of the bolt 321.

The center of the disc is pierced by a hole, perpendicular to the plane of the disc, into which is pressed a thin walled stainless steel bush 326 bell-mouthed at both ends, which acts as a fairlead for the rudder control line 61.

A stainless steel U-piece 33 is located beneath the disc 32 and attached to it by pivot bolts 331 which are positioned on an axis at right angles to that of pivot bolts 321. The bolts 331 pass through stainless steel washers 332 and the tongues of the U-piece 33 before being screwed into the disc 32 and locked in the same way as bolts 321.

The U-piece 33 is pivotally connected to the base bracket 34 by a hollow stainless steel bolt 351 which is secured by nut 352. The nut, bolt and base bracket are all of stainless steel, and the nut should be a self-locking type as a transverse split pin would impede the path of the rudder control line through the center of the bolt 351. Hard nylon washers 353 are interposed between the bolt head, U-piece, base bracket and nut. The longitudinal axis of the bolt 351 represents the yaw axis of the rig, and passes through the center of the disc 32. Each end of the hole through the bolt is countersunk and de-burred to minimize the possibility of wear of the rudder control line which passes through it.

The base bracket 34 is fabricated from a single sheet of stainless steel and is square in planform. From the square upper surface the sheet is turned to form four sides. At the bottom of three of the sides the sheet is turned outwards to form flanges which are screwed to the deck of the hull. The bottom of the fourth side is turned inwards to form a flange which extends parallel to and slightly above the deck. The base bracket is positioned with one of its diagonals aligned with the longitudinal axis of the hull as this simplifies the routing of the rudder control line so as to avoid that part of the center-board which may protrude above the deck.

A guide sheave 341 is mounted on a shouldered pin 342 and located laterally by spacer tubes (not shown) and washers (not shown). The ends of the pin 342 are carried in holes in two sides of the base bracket 34 and are retained by being peened over on the outside of the bracket. The sheave 341 is positioned to ensure that the upward-going part of the rudder control line leaves its periphery along the axis of the hollow bolt 351.

A second guide sheave 345 is mounted on a second shouldered pin 346 and is located vertically by spacer tube 347 and washers 348. The ends of pin 346 are carried in holes in the inward turned flange and the top of the base bracket 34 and secured in the same way as pin 342.

After leaving the bottom of the periphery of sheave 341 the rudder control line 61 turns through approximately 45° round sheave 345 before leaving the base bracket through a clearance slot 349, cut in the side which has the inward turned flange.

A swivel link may be provided in the control line 61, located within the universal joint assembly in order to prevent twisting of the control line as a result of yawing (rotation) of the rig about a vertical axis. Alternatively, or additionally, a swivel link may be provided in the line 61 at some point between the universal joint and the twist gap 631 mounted on the forward cross-strut.

The universal joint assembly should preferably be fitted with circular section plastic foam fairings and then shrouded by a molded rubber gaiter, both to minimize the ingress of sand etc and also to protect the crew from injury by the comparatively sharp corners of the structural components. The gaiter and fairings are not essential for the operation of the rig and have been omitted from the diagrams in the interests of clarity.

The disposition of the twist grips 631, 633 and 634 on the lateral frame is shown in FIGS. 4 and 6. Each twist grip is a straight circular tube of a semi-rigid plastic such as polyethylene. (Excessive rigidity could cause binding of the twist grip if the strut or boom which it enclosed experienced bending under operational loads). The twist grips are located longitudinally by end stops comprising thick stainless steel washers which are bent to conform with the profile of the boom or strut to which they are pop-rivetted.

Figure 8:
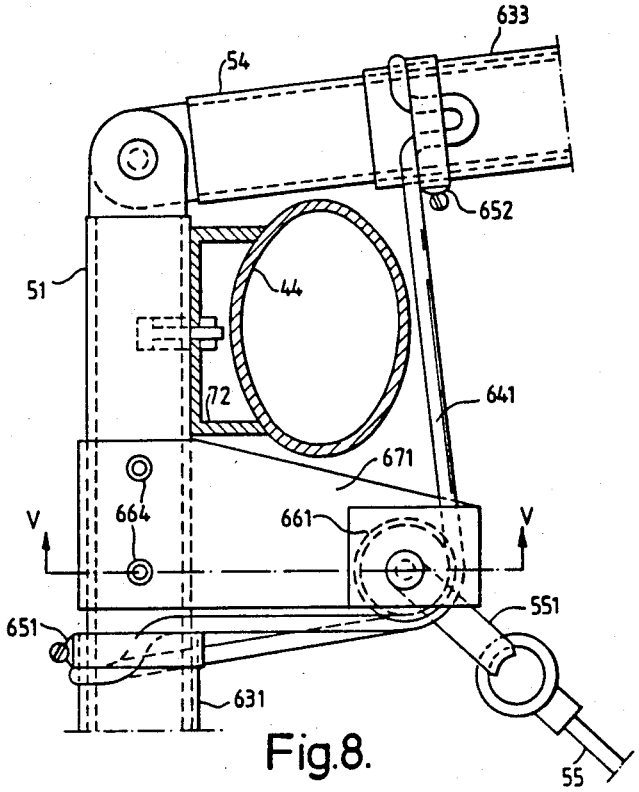
FIG. 8 is a part-sectional plan view similar to FIG. 7 but showing details of the connection between a boom and the forward cross-strut.
Figure 9:
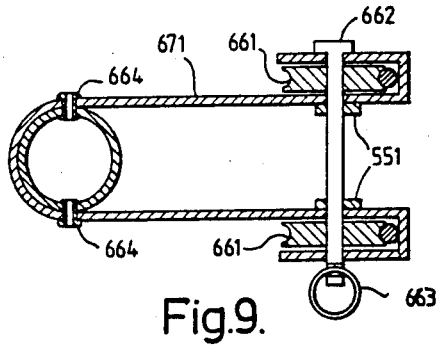
FIG. 9 is a cross-sectional view taken on the line V—V in FIG. 8.

Referring to FIGS. 8 and 9 a steering link is provided at the forward starboard corner of the lateral frame 5 between twist grips 631 and 633. One end of connecting loop 641 is permanently clamped to the forward twist grip 631 by hose clip 651 which it crosses under on its way round the twist grip. From twist grip 631 the upper and lower legs of the connecting loop pass round guide sheaves 661 mounted on bracket 671, and then on to the forward end of twist grip 633 to which they are clamped by hose clip 652. (This clip is slackened and the loop freed when the frame is dismantled for transport).

As can be seen best in FIG. 9, sheaves 661 are mounted in bracket 671 for rotation on pin 662 which is secured by spring retaining ring 663. The bracket 671 is fastened to the forward cross strut by pop rivets 664 and also provides an anchorage for the foward end of cross-bracing cable 55, via shackle 551.

The rudder control line 61 is clamped to the center of the forward twist grip by another hose clip. Mid-way between this point and the universal joint the control line incorporates a swivel link which enables the rig to rotate freely in yaw without imposing excessive twist on the control line. The line can be unshackled from one end of this link when the rig is dismantled for transport.

Figure 12:
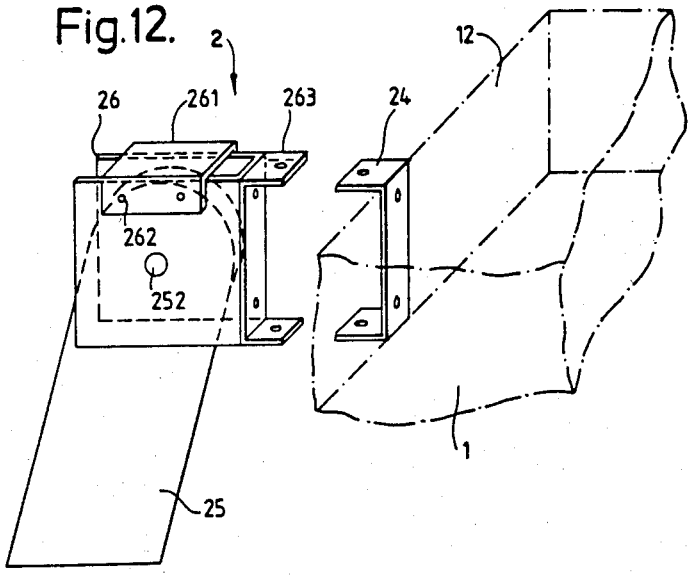
FIG. 12 is a perspective view of the rudder, with the operating sheave omitted, of the sailboard shown in FIG. 4.

Referring to FIG. 12, the rudder assembly 2 is attached to the hull 1 by a stainless steel bracket 24 which is itself screwed to the transom 120.

The rudder blade 25 is clamped between the sides of a deep channel 26 formed from heavy gauge aluminum alloy sheet, by a pivot bolt 251 and a steel nut (not visible in this view). The top of this channel is stabilized by another aluminum alloy channel 261 which is fastened to it by pop rivets 262. Another stainless steel bracket 263 is pop rivetted to the forward face (base) of the deep channel 26, and is a running fit within bracket 24 when the rudder 25 is attached to the hull 1.

The rudder operating sheave (of nylon or acetal) is mounted on the top of the stainless steel rudder pin 23. On assembly, the pin 23 is passed down through holes in brackets 24 and 263, locking them together but leaving the rudder free to rotate about the pin 23. The pin 23 is retained in this position by a stainless steel spring strip 211 which is screwed to the under-side of the sheave 21. The strip 211 is bent to a profile which ensures that, as the sheave is pushed downwards, the strip 211 enters the top of channel 26. As the sheave 21 reaches its operating position, the rearward part of the strip springs aft and a step 2111 formed in its profile engages with the under-side of channel 261. This actions locks the sheave 21 in its operating position unless and until the spring strip 211 is deliberately compressed and pulled upwards.

The width of the strip is chosen to be a close running fit inside channel 26, thus enabling it to transmit the steering moments from the sheave 21 to the channel 26.

The rudder control line 61, which is preferably of braided construction, is fastened to the rearward part of the sheave 21 by a screw 212 which passes through the center of the line. Additional security is provided by clamping pressure applied via washer 213. FIG. 13 is a section through the sheave 21 showing the position of the control line 61 when clamped by the screw 212.

Although it is not practicable to use twist grips on curved wishbone booms and is difficult to arrange a satisfactory drive from staight-sided wishbones, nevertheless most of the components of the steering system for twin sail rigs can be utilized unchanged in a single masted sailboard.

The same rudder assembly can be used without modification, as can most of the universal joint assembly. The exception is the need to replace the Y-piece with an equivalent component designed for use with a single mast. The replacement component is plugged into the foot of the mast and is molded from structural plastic. The molded incorporates mountings for guide sheaves which divert the rudder control line from the axis of the mast to a position ahead of it.

Figure 14:
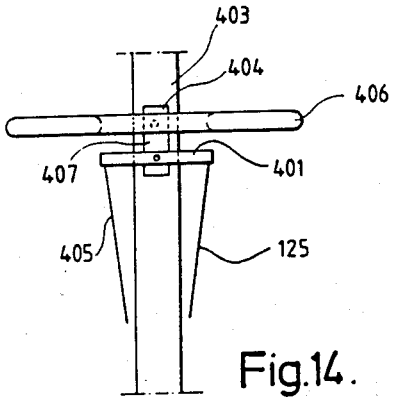
FIG. 14 is a front elevation of the wishbone (and part of the mast) of a single-masted sailboard and showing one embodiment of part of the steering control system.

The twist grip problem is overcome by utilizing rotation of the wishbone about its longitudinal axis to operate the rudder as shown in FIG. 14.

FIG. 14 shows a front elevation of an orthodox wishbone 406 and part of a mast 403 of a conventional single-masted sailboard, e.g. as shown in British Patent No 1551426. The wishbone has a straight cross-strut 406 which is mounted on the mast by means of a fitting 407 similar to that shown in FIGS. 10 and 10*a*. The spigot of the fitting 407 engages in a hole in the rear of the cross-strut 406, and the wishbone is held in place by a lashing of the kind shown in FIG. 11. This lashing would permit limited rotation of the wishbone about its longitudinal axis, e.g. about 30°. Mounted on a second spigot projecting from the same fitting 407, is a short rocker bar 401. A rudder control line 125 is attached to one end of the rocker bar 401, while an elastic cord 405 is attached to the other end. The rudder control line 125 is guided around a sheave (not shown) through a slot in the front of the universal joint assembly and then around one or more further sheaves within the assembly so that it emerges from another slot along a path similar to rudder line 61 in FIG. 4. The rudder, sheave and return spring are essentially similar to the arrangement shown in FIG. 4. Elastic cord 405 is secured at the end remote from the rocker bar 401 to a cleat (not shown) on the mast and acts as a return spring to counter the return spring on the deck (equivalent to spring 621 in FIG. 4) and thereby hold the rudder in the neutral position in the absence of any deliberate control input. A swivel link would normally be provided in the control line 125.

It will be appreciated that small movements (eg. possibly involuntary variations) of the wishbone about its longitudinal axis (ie. about its spigot on fitting 407) will have no effect on the rudder. However, large movements will cause the wishbone to touch the rocker bar and cause the rudder to be deflected in one direction or the other, depending on the direction of rotational movement of the wishbone.

The sensitivity or "gear ratio" of the steering system can be varied by altering the distance of the point of attachment of the control line 125 from the spigot about which the wishbone rotates.

Of course, the rudder control line 125 could, alternatively be connected directly to the wishbone but this would mean that the crew would need to hold the wishbone very steadily in order to avoid repeated variation in the course sailed.

Operation of Twin-Sailed Craft in accordance with the inventions described herein The following notes refer to a single-handed sailboard utilizing both the twin sail rig and the steering system.

At high speeds the rig may tend to lift the crew off the board, and so, although omitted from the accompanying drawings, the provision of toe straps is advisable.

It should be noted that this discussion does not refer to the case of running before the wind, except where expressly stated.

There are two distinct classes of rig position. In the more important class, one sail is normally vertical (and in that position performs similar functions to the main sail of a dinghy), whereas the other sail is approximately horizontal. In the other class, the sail positions are approximately symmetrical about a vertical plane.

In the first class, the crew holds the twist-grip on the windward boom. This enables him to support the rig, and to rotate it:

(1) In pitch, about a lateral axis, to control the incidence of the "horizontal" sail.
(2) In yaw, about a vertical axis, to control the incidence of the vertical sail.
(3) In roll, about a longitudinal axis, to exchange the functions of the two sails when tacking or gybing.

Rotation of the twist-grip itself operates the rudder. In addition to steering, the rudder provides directional stability in the same way as the skeg of a conventional sailboard.

When sailing on a steady course, the crew's objective is normally to maximize forward speed while retaining control. As with conventional craft the prime concern is the control of roll. However, with the twin sail rig vertical movement could also present difficulties. Two regions can be distinguished.

"Critical"-where the lift force generated by the "horizontal" sail approaches the total weight of the crew and sailboard.

"Sub-critical"-where the lift force is significantly less than the total weight.

Although surface conditions can cause complications, the main disturbing factor is variation of wind speed and direction. The techniques available to counter these disturbances depend on the regime in which the sailboard is operating.

It is convenient to consider the "Sub-critical" case first. Variations of wind speed have similar effects on both sails, and so to a large extent compensation for these changes is automatic. However, as the "horizontal" sail is nearer the surface, it will experience a lower average wind speed, and so the sail rolling moments will not remain exactly balanced. Nevertheless, the additional manual adjustments required will be relatively small and should present no difficulty.

Changes in wind direction are not automatically compensated, since their effect on the vertical sail is much greater than on the "horizontal" sail. When operating in the "Sub-critical" regime the crew has three techniques available to counter these disturbances. For example, if, as a result of a change of wind direction, the vertical sail force increases by a greater amount than the "horizontal" sail force, he may:

(1) Lean back and pull on the boom, as with a conventional sailboard.
(2) Rotate the rig about the vertical (yawing) axis to reduce the incidence of the vertical sail.
(3) Rotate the rig about the lateral (pitching) axis to increase the incidence of the "horizontal" sail.

(The converse of these actions can of course be used to counter a reduction of vertical sail force.)

Although any of the techniques may be used alone, or in combination with one or both of the others, the first has the disadvantages which handicap the conventional sailboard and is not recommended. Of the others, the second tends to maintain the forces and forward speed existing prior to the disturbance. By contrast, the third increases both forces and speed and so takes the operation closer to the "Critical" regime.

For the "Critical" regime it is convenient to consider the variation of wind direction first. Although the same three techniques are nominally available (to counter an increase of vertical sail force), additional constraints apply.

Firstly, leaning back is even less desirable as additional body movement would make precise control of the rig more difficult.

Secondly, increasing the "horizontal" sail force to balance the vertical sail could lead to the lift exceeding the total weight of sailboard and crew, and to the board leaving the water. Although such an occurrence could reduce hydrodynamic resistance, it would also cause a reduction, and possibly total loss, of directional control and should therefore be avoided. (An exception is the case of deliberate jumping where the crew may use the performance of the twin sail rig to attain a high speed before deliberately increasing the incidence of one or both sails with the intention of leaving the water). However, the sail rolling moments must be balanced and so in this case the crew has no option but to reduce the incidence of the vertical sail. Thus, the need for the dagger board and rudder to remain immersed for normal operation sets an upper limit to the lift force, and hence to the propulsive force which can be balanced. (Nevertheless, this maximum propulsive force is significantly higher than that which could be attained by a conventional sailboard).

Increases of wind speed which occur in the "Critical" regime cannot be countered by "automatic compensation" since this would probably require excessive lift. Consequently, in this case, the crew must counter the change by reducing the incidence of both sails.

Although, when sailing on a steady course, roll stability and the avoidance of "take-off" are the major control problems, the crew must also maintain satisfactory longitudinal trim. As there are no aerodynamic factors to assist him, he must control trim by movement of his own weight along the board.

The second class of rig positions comprises variations which may prove useful in particular circumstances.

Firstly, for close-hauled and reaching courses in very light winds, roll stability is not a problem, the potential reduction of displacement due to lift is negligible, and the generation of maximum propulsive force is the prime consideration. It is therefore preferable for both sails to contribute to propulsion. With both sails set at 45° to the horizontal, the vertical force components cancel out, and the sum of the horizontal components is nominally 41% greater than the horizontal force available with one of the sails set vertically. In practice, aerodynamic interaction between the sails (and with the crew) would reduce this increment, although some advantage would probably remain. (The crew would be obliged to stand upwind rather than to the side of the rig).

Secondly, when running before the wind, the rig may be tilted forward symmetrically (with the masts near horizontal) to increase the projected cross-wind area of the rig by about 41%. Although the center of area is then lower than normal, and so encounters lower wind speeds, a net gain of propulsive force is likely. This gain is of particular significance in light winds.

Paradoxically, this method of running before the wind may also be of use when the wind is too strong for the rig to be controllable with one sail vertical. In this case, the symmetrical construction and disposition of the rig would minimize rolling and yawing moments and the probability of capsize, especially if the crew raised the dagger board and crouched or sat near the stern. Control in such situations would be improved by the provision of rig uphauls attached to the aft ends of the booms. The crew could use these together, to lift the rig slightly (and reduce the danger of wave impact on the masts), and differentially to provide a limited form of steering.

Although the symmetrical uses of the rig outlined above may yield improved performance in particular circumstances, they should be regarded primarily as expedients which may be employed to cope with unexpected changes of wind strength whilst afloat.

Before going afloat, the crew should assess the existing and expected wind strengths and adjust the rig configuration accordingly. Ideally the adjustments would comprise:

(1) Selecting the size of sails to be used, as with conventional sailboards.

(2) Setting the inter-sail angle and roll pivot height according to wind strength and water conditions. With light winds and smooth water, the rig could be raised and the inter-sail angle increased to improve efficiency. With high winds, the rig would be lowered to minimize the rolling moment arm of the vertical sail, and the inter-sail angle reduced to improve wave clearance.

Although making these adjustments is primarily a preparatory task, it is possible to provide modifications of the rig as described above which incorporate features enabling rig height and inter-sail angle to be changed while afloat.

The techniques involved in the two basic maneuvers of tacking and gybing differ considerably from their equivalents for conventional sailboards. The main reason for this difference is the requirement for the two sails to exchange functions as the wind moves round to the opposite side of the board.

The gybing procedure is the more complex as, in addition to the 90° "roll" by which the sails exchange function, the rig must rotate by approximately 180° in plan. (Rig rotation in plan during tacking is much less, typically about 45°).

The preceding description has covered the basic concepts, construction and particular embodiments and some optional features.

In a further aspect, the invention also relates to sailboards in which a water rudder is provided which is operable by a single crew member without involving a rotational steering control (such as a twist grip mounted on one of the booms). This concept includes a tiller attached to the rudder and which can be held in a series of fixed positions. A suitable constructon may comprise a rack mounted on the deck of the hill, the notches in the rack being dimensioned to correspond with the profile of the tiller. Obviously, other constructions are possible, such as a series of pins which engage in a hole in the tiller. The tiller would include a link to the rudder so that it can be readily disengaged from one notch and engaged with another. At the end of the tiller remote from the rudder, it would be convenient to provide some means for grasping the tiller to lift it and move it laterally. This may include an extension arm or even a ring or loop so that the tiller could be moved by the crew's foot. With such a steering arrangement it would be possible for the crew to make rapid changes of course (especially when wearing a harness connected to the boom) but would not need to hold the tiller continuously.

I claim:

1. A sailboard comprising:

(a) a hull having an unstayed rig structure mounted thereon via a joint assembly which permits the rig structure to be pivoted about three mutually perpendicular axes, (b) said rig structure including a pair of masts, each of which in use supports a sail, and (c) means on said rig structure adapted to be grasped by a crew member so that a single crew member standing on the sailboard can rotate the rig as a unitary structure:

(i) about an approximately vertical axis to trim a first sail to the wind to provide forward propulsion, (ii) about a first approximately horizontal axis to trim a second sail to the wind to provide upward lift at the leeward side of the sailboard to counter the rolling or heeling moment appled to the sailboard by the wind impinging on the first sail, and (iii) about a second approximately horizontal axis from a first position in which a first mast extends substantially vertically and a second mast extends generally at right angles thereto away from the hull to a second position in which the second mast extends substantially vertically and the first mast extends generally at right angles thereto away from the hull.

2. A sailboard as defined in claim 1, wherein the two masts are linked together so that the angle included between the planes of the sails is from about 75° to 105°.

3. A sailboard as defined in claim 2, wherein the linkage between the masts is adjustable thereby allowing the angle included therebetween to be varied.

4. A sailboard comprising:

(a) a hull having an unstayed rig structure mounted thereon via a joint assembly which permits the structure to be pivoted about three mutually perpendicular axes, (b) said structure including a pair of masts having inboard and outboard ends and connected at their inboard ends to said joint assembly, (c) each mast having a sail attached at an edge thereof and a boom member connected at one end to a mast and at the other end to its associated sail, and (d) means for linking the masts outboard of the joint assembly, (e) whereby in use a single crew member standing on the sailboard can rotate the rig as a unitary structure:

(i) about an approximately vertical axis to trim a first sail to the wind to provide forward propulsion, (ii) about a first approximately horizontal axis to trim a second sail to the wind and to provide upward lift at the leeward side of the sailboard to counter the rolling or heeling moment applied to the craft by the wind impinging on the first sail, and (iii) about a second approximately horizontal axis from a first position in which a first mast extends substantially vertically and a second mast extends generally at right angles thereto away from the hull to a second position in which the second mast extends substantially vertically and the first mast extends generally at right angles away from the hull.

5. A sailboard as defined in claim 4 wherein the masts are linked by cross struts which form with the booms a quadrilateral frame, whereby a single crew member can control the rig structure by grasping one of the booms.

6. A sailboard as defined in claim 5 wherein the quadrilateral frame is stabilized by diagonal bracing lines.

7. A sailboard as defined in claim 4 wherein the junction of the inboard ends of the masts is spaced above the deck of the hull.

8. A sailboard as defined in claim 4, wherein the mast structure comprises a pair of masts which are linked together so that they include an angle of between 75° and 105°.

9. A sailboard as defined in claim 4, wherein there is associated with each boom a steering control and means responsive to the movement of said steering control for transmitting said movement to a water rudder.

10. A sailboard as defined in claim 9, wherein said steering control comprises a twist grip which is rotatably mounted on each said boom and is connected by at least one control line to said rudder.

11. A sailboard as defined in claim 10, wherein said control line is constrained to follow a path which passes through said joint assembly.

* * * * *